United States Patent [19]

Simmons et al.

[11] Patent Number: 4,595,143

[45] Date of Patent: Jun. 17, 1986

[54] AIR SWIRL NOZZLE

[75] Inventors: Harold C. Simmons, Richmond Hts.; Curtis F. Harding, Parma, both of Ohio

[73] Assignee: Parker-Hannifin Corporation, Cleveland, Ohio

[21] Appl. No.: 516,006

[22] Filed: Jul. 20, 1983

[51] Int. Cl.[4] ..... B05B 7/10

[52] U.S. Cl. ..... 239/406; 239/400

[58] Field of Search ..... 239/400, 402, 405, 406

[56] References Cited

U.S. PATENT DOCUMENTS

| | | | |
|---|---|---|---|
| 351,390 | 10/1886 | Mitchell | 239/406 |
| 1,342,732 | 6/1920 | Anthony | 239/405 |
| 1,396,086 | 11/1921 | Anthony | 239/400 |
| 1,451,063 | 4/1923 | Anthony | 239/406 |
| 2,942,790 | 6/1960 | Starkey | 239/405 |
| 3,804,333 | 4/1974 | Kramer et al. | 239/406 |
| 4,139,157 | 2/1979 | Simmons | 239/406 |

*Primary Examiner*—Joseph F. Peters, Jr.
*Assistant Examiner*—Michael J. Forman
*Attorney, Agent, or Firm*—Frederick L. Tolhurst

[57] ABSTRACT

A fuel nozzle wherein a swirl cone (36) is located between a housing (10) and a body (12). Body (12) cooperates with housing (10) to form an air chamber (32) and with cone (36) to form an inner annulus (40). Swirl vanes (34) are angularly mounted between cone (36) and body (12) such that air flowing from chamber (32) into annulus (40) forms a swirling flow pattern. Body (12) is provided with a fuel chamber (16) and radial passages (20) introduce fuel to the swirling air in inner annulus (40) to produce an atomized spray pattern.

14 Claims, 5 Drawing Figures

AIR SWIRL NOZZLE

BACKGROUND OF THE INVENTION

1. Field of the Invention

The subject invention is directed to nozzles that provide a controlled spray pattern and, more particularly, fuel nozzles for providing atomized fuel to a combustion chamber.

2. Description of the Prior Art

Various types of fuel nozzles are known in the prior art. For example, pressure atomizer nozzles produce a spray pattern by passing the fuel through an orifice under pressure. Another type of fuel nozzles is the prefilming type nozzle wherein the fuel is swirled in an annular passage before it is mixed with air. One example of this type of nozzle is shown in U.S. Pat. No. 3,980,233 to Simmons, et al.

Some recent applications for fuel nozzles require intermittent operation for spraying volumes of fuel that are relatively small in comparison to prior art applications. For example, in some recent applications, nozzles must operate at fuel flow rates approximately ten times less than flow rates typical for aircraft application.

Downsizing prior art nozzles to accommodate these lower fuel flow rates has presented a variety of problems. For example, the relatively small orifices of the downsized nozzles were difficult to make and were subject to being plugged with particulate contaminants in the fuel. Guarding the fuel orifices with low micron rated filters is costly and inconvenient due to the frequent servicing requirements.

Because of the low fuel flow requirements, merely increasing the size of the fuel orifices so that particulate contaminants would pass through the orifices, did not permit sufficient fuel velocity to produce an acceptable spray pattern. For example, under such conditions pressure atomizer type nozzles simply did not atomize. Prefilming air-blast nozzles did not prefilm the fuel, resulting in poor atomization and fuel distribution. Moreover, in some nozzles the angle of the spray pattern is partially dependent on the fuel flow rate. This decrease in fuel flow rate produces unacceptable changes in the spray pattern angle.

Accordingly, there was a need in the prior art for a smaller, reliable nozzle that would produce a desirable spray pattern at low fuel flow rates.

SUMMARY OF THE INVENTION

In accordance with the subject invention, a fuel nozzle includes a nozzle body that is provided with a housing and a swirl cone located between the body and housing, adjacent the output end of the nozzle. The body and housing cooperate to form an air chamber. The swirl cone cooperates with the nozzle body to form an inner annulus and cooperates with the housing to form an outer annulus. The body has an internal fuel chamber and radially aligned passageways that communicate between fuel orifices and the fuel chamber. A plurality of vanes are connected between the swirl cone and the body and located between the air chamber and the inner annulus radially outwardly of the fuel orifices. The vanes are centered with respect to the longitudinal axis of the body to provide an air swirl adjacent the fuel orifices.

Preferably, the swirl cone further includes a plurality of air passageways that communicate between the air chamber and the outer annulus, each of the air passageways being tangentially aligned with respect to the longitudinal center axis of the nozzle.

Also preferably, the subject nozzle includes a cover that receives and cooperates with the housing to form an annular cavity that communicates with the air chamber through an input channel.

Other details, objects and advantages of the subject invention will become apparent from the following description of a presently preferred embodiment thereof.

BRIEF DESCRIPTION OF THE DRAWINGS

The accompanying drawings show a presently preferred embodiment of the invention wherein.

DESCRIPTION OF THE PREFERRED EMBODIMENT

Figure 1:
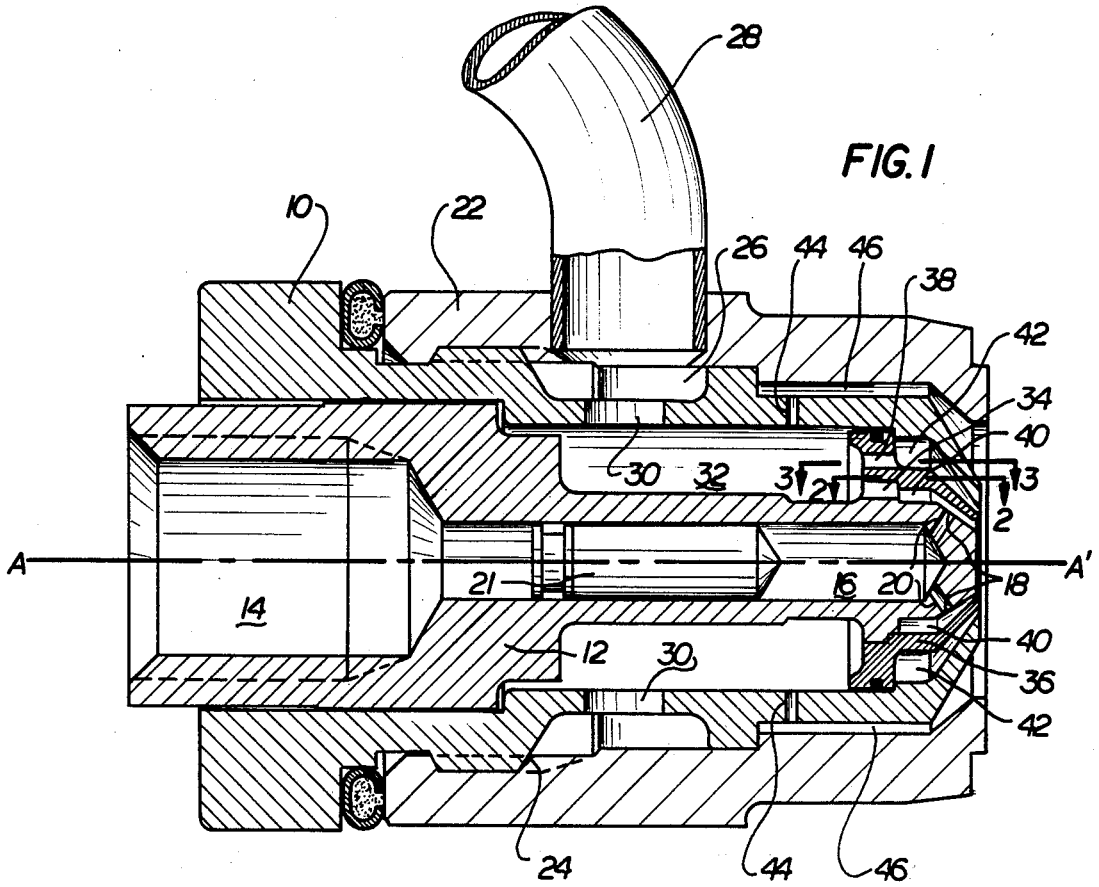
FIG. 1 is a cross-section of a preferred embodiment of a nozzle in accordance with the subject invention.
Figure 2:
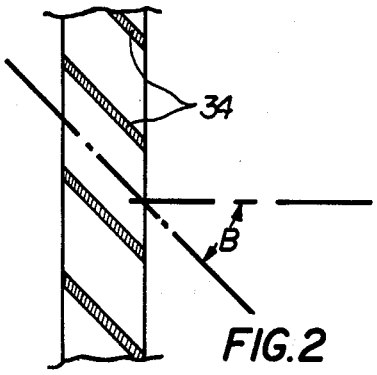
FIG. 2 is a partial section of the nozzle of FIG. 1 taken along the lines 2—2.
Figure 3:
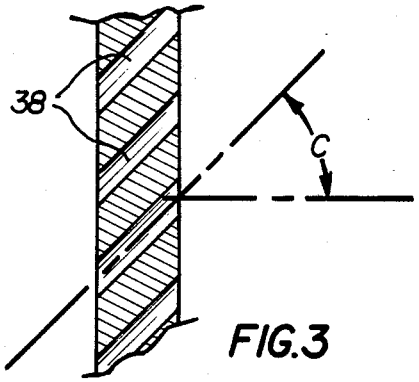
FIG. 3 is a partial section of the nozzle of FIG. 1 taken along the lines 3—3.

Referring to FIGS. 1–3, a preferred embodiment of a nozzle in accordance with the subject invention includes a housing 10 that is provided with a central cavity wherein a nozzle body 12 is engaged. Body 12 is provided with first and second fuel chambers 14 and 16 respectively located in tandem arrangement. Second, fuel chamber 16 has a smaller cross-sectional area than first fuel chamber 14 and communicates with fuel orifices 18 through respective fuel passages 20 provided at one end of nozzle body 12. Each of fuel passages 20 are radially arranged with respect to the longitudinal center axis A-A' of body 12 such that each of fuel passages 20 are substantially aligned on a respective axis that intersects the longitudinal center axis. In the embodiment of FIGS. 1–3, a check valve 21 is included in fuel chamber 16.

A cover 22 is connected to the outside of housing 10 by threads 24. An annular channel is longitudinally located in housing 10 adjacent an air supply hose 28 and cooperates with the internal surface of cover 22 to form an air supply cavity 26. A plurality of ports 30 are provided in the base of cavity 26 to provide communication between cavity 26 and an air chamber 32 formed between housing 10 and nozzle body 12.

Swirl vanes 34 are attached to nozzle body 12 adjacent to fuel orifices 18, vanes 34 being located between air chamber 32 and fuel orifice 18 and being at a greater radial distance from longitudinal axis A-A' than fuel orifices 18. Vanes 34 support a swirl cone 36 that is concentrically arranged with respect to body 12. Swirl cone 36 is connected concentrically to nozzle body 12 and cooperates with nozzle body 12 to define inner annulus 40 and cooperates with housing 10 to define outer annulus 42. As particularly shown in FIG. 2, swirl vanes 34 are angularly arranged, or canted, at an angle B with respect to the longitudinal axis A-A' such that air flowing from chamber 32 past vanes 34 to inner annulus 40 assumes a swirling flow pattern downstream of vanes 34.

Swirl cone 36 is provided with a plurality of passageways 38 that are also angularly arranged with respect to longitudinal axis A-A' at an angle C such that each of passageways 38 are aligned on a respective axis that lies in a plane parallel to the center axis. Thus, air flowing from chamber 32 through passageways 38 to outer annulus 42 develops a swirl pattern. Preferably, passageways 38 are arranged in the opposite sense from the angular arrangement of vanes 32 so that air downstream of passageways 38 in outer annulus 42 is swirled in counter-rotation to air downstream of vanes 34 in inner annulus 40. Alternatively, for applications in which swirled air in outer annulus 40 is not required, passageways 38 can be aligned on respective axes that are parallel to the center axis or that are in skewed relationship other than that shown and described with respect to the embodiment of FIGS. 1–3.

In the embodiment of FIGS. 1–3, body 12 is further provided with a plurality of radial passageways 44 that communicate between air chamber 32 and an annular cavity 46. Air flowing from cavity 46 retards deposition of carbon on the front face of the nozzle.

In the operation of the embodiment of FIGS. 1–3, air is provided through supply hose 28 and annular cavity 26 to air chamber 32. The air in chamber 32 flows past vanes 34 to inner annulus 40 and flows through passageways 38 to outer annulus 42. Air in chamber 32 also flows through passageways 44 and annular cavity 46. Due to the angular orientation of vanes 34 and passageways 38, a swirling motion is imparted to the air flowing in inner annulus 40 and outer annulus 42 such that a vortex is developed. The restriction of air flow by vanes 34 and passageways 38 also establishes a pressure drop between chamber 32 and annulus 40 and 42 and increases the flow velocity of the air swirling in inner annulus 40 and outer annulus 42.

At the same time, fuel is provided to first and second fuel chambers 14 and 16. Preferably, chambers 14 and 16 are of relatively small cross-section to limit the fill time for the nozzle at a given fuel flow rate. Fuel in fuel chamber 16 flows through radial passages 20 to fuel orifices 18 where it is introduced to the high velocity, swirling air in inner annulus 40.

Since passages 18 are radial and have no tangential component, the fuel from orifices 18 is not swirled. However, the radial location of vanes 34 from which the swirling air is provided to inner annulus 40 is greater than the radial location of fuel orifices 18 through which the fuel is provided. Thus, the fuel is introduced into a fully developed vortex of high velocity air that provides complete and uniform dispersion of fuel.

Because the nozzle of the subject invention accomplishes fuel dispersion by mixing the fuel with swirling air, the fuel contributes no tangential momentum to the spray pattern. Thus, the spray pattern is substantially independent of fuel pressure and velocity and no fuel metering inside the nozzle is required. Accordingly, the cross-sectional area of fuel orifices 18 is not critical and fuel orifices 18 are made large enough to pass contaminant particulates within an expected size range - a size that is substantially larger than that required to provide adequate fuel flow.

The fuel and air mixture exits inner annulus 40 in an atomized dispersion that is evenly distributed in a conical pattern. This dispersion pattern is further defined and controlled by the air exiting from outer annulus 42 which impacts the outside of the flow from annulus 40.

Where check valve 21 is included in fuel chamber 16, only the volume of chamber 16 between check valve 21 and passages 20 must be filled before fuel exits orifices 18 and the spray pattern is formed. Thus, the fill time for the nozzle is substantially reduced. Limiting nozzle fill time is particularly important in applications where ignition delay time is a significant factor as, for example, under conditions of fuel flow and intermittent ignition.

Figure 4:
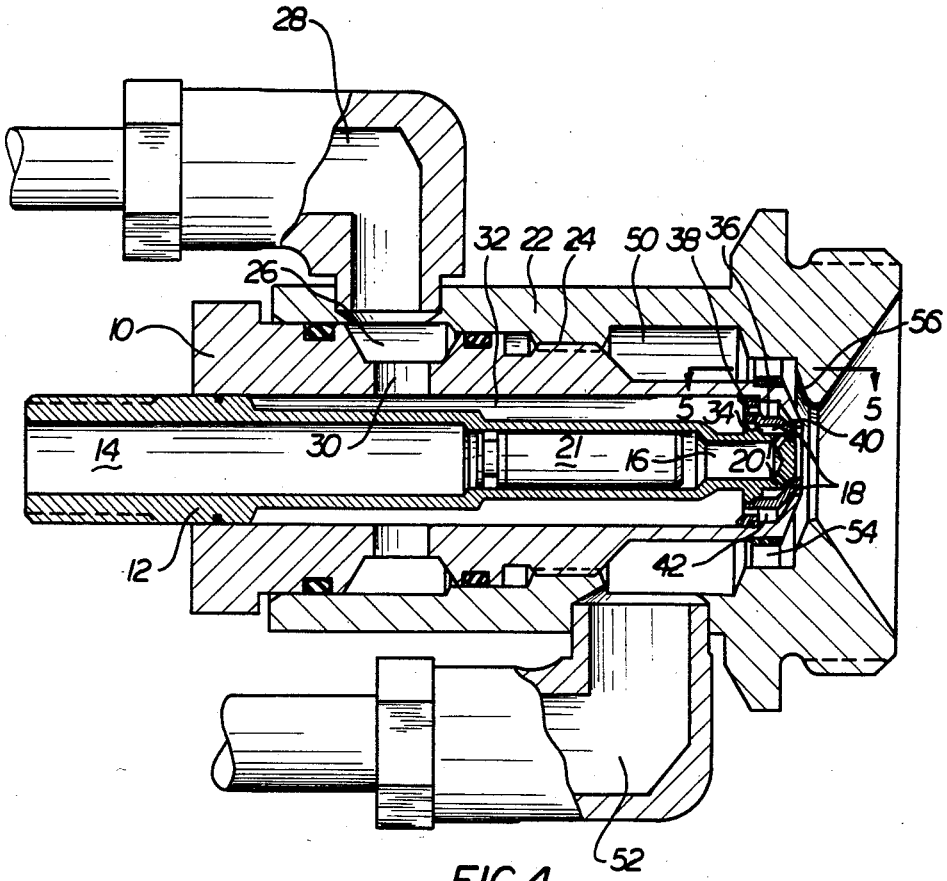
FIG. 4 is a cross-section of an alternative embodiment of a nozzle in accordance with the subject invention.
Figure 5:
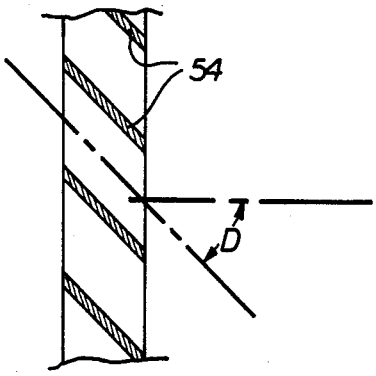
FIG. 5 is a partial section of the nozzle of FIG. 4 taken along the lines 5—5.

FIGS. 4 and 5 show an alternative embodiment of the subject invention wherein equivalent parts are identified by reference numbers corresponding to the embodiment of FIGS. 1–3. However, in the embodiment of FIGS. 4 and 5, a separate plenum 50 has been included.

Plenum 50 is not in communication with air chamber 32 as is annular cavity 46 of the embodiment of FIGS. 1–3. Instead, plenum 50 is supplied with air from supply line 52 through a port in cover 22. Adjacent one end of plenum 50 is an array of vanes 54 that are, angularly arranged, or canted, with respect to the longitudinal central axis of the nozzle. An air blast annulus 56 similar to annular cavity 46 of the embodiment of FIGS. 1–3 is located on the downstream side of vanes 54 and is open to the exit face of the nozzle.

In a manner similar to the operation of vanes 34, vanes 54 establish a high velocity air swirl in annulus 56. This air blast inhibits the accumulation of carbon and other combustion particles on the exit face of the nozzle.

While a presently preferred embodiment of the invention is shown and described herein, the scope of the subject invention is not limited thereto, but can be otherwise variously embodied within the scope of the following claims.

We claim:

1. A nozzle comprising:

a housing a nozzle body engaging said housing and cooperating therewith to form an air chamber, an air inlet to said air chamber, said nozzle body having a fuel inlet, at least one fuel chamber and at least one fuel outlet orifice that communicates with the fuel chamber through a fuel passageway, said fuel passageway being substantially aligned on an axis that intersects a longitudinal center axis of the body;

a swirl cone that is located between said housing and said body, said swirl cone cooperating with said body to form an inner annulus with said at least one fuel orifice included therein, said swirl cone also cooperating with said housing to form an outer annulus, said inner and outer annuli communicating with said air chamber, said inner annulus terminating in an inner annular outlet, said outer annulus terminating in an outer annular outlet; and a plurality of vanes that are connected to said body and said swirl cone, said vanes being located between said air chamber and said inner annulus, said vanes being canted with respect to the longitudinal center axis of said nozzle body.

2. The nozzle of claim 1 wherein said swirl cone includes a plurality of air passageways communicating between said air chamber and said outer annulus, each air passageway being aligned on an axis that is skewed with respect to the longitudinal center axis of the nozzle such that they do not intersect the longitudinal center axis.

3. The nozzle of claim 2 wherein said air passageways are aligned on an axis that lies in a respective plane parallel to the center axis.

4. The nozzle of claim 2 wherein said housing includes a plurality of ports between the outside of the housing and the air chamber, said nozzle further comprising:

a cover that receives at least part of said housing and cooperates with the housing to form an annular channel that includes the outside end of said ports in said housing.

5. The nozzle of claim 2 further comprising a cover that receives at least part of said housing and cooperates. with said housing to form an annular cavity, said housing having at least one passageway to the annular cavity, said annular cavity having an annular cavity outlet disposed radially outwardly from said outer annular outlet.

6. The nozzle of claim 5 wherein said cover and said housing cooperate to form an annular plenum, said nozzle farther comprising:

a second plurality of vanes, said second vanes being connected between said cover and said housing and located between said plenum and said annular cavity, said second vanes being angularly arranged with respect to the longitudinal axis of the nozzle such that air flowing from said plenum past said second vanes to said annular cavity is swirled in said annular cavity.

7. The nozzle of claim 6 wherein said cover includes said air inlet that communicates with said air chamber.

8. The nozzle of claim 5 wherein said passageway is located between said air chamber and said annular cavity.

9. A fuel nozzle comprising:

a housing a cover that extends over at least one end of said housing and cooperates with the housing to form an annular channel and an annular cavity, said cover provided with an air inlet to said annular channel;

a nozzle body located inside the housing and cooperating with said housing to form an air chamber, said air chamber communicating with said annular channel and said annular cavity, said nozzle body having a fuel inlet, at least one fuel chamber communicating with at least one fuel orifice through respective passageways, said passageways being substantially arranged in intersecting alignment with a longitudinal center axis of the body;

a swirl cone located between said housing and said body, said swirl cone cooperating with said body to form an inner annulus with said at least one fuel orifice included therein; said swirl cone also cooperating with said housing to form an outer annulus, said inner and outer annuli communicating with said air chamber, said inner annulus terminating in an inner annular outlet, said outer annulus terminating in an outer annular outlet, said annular cavity having an outer cavity outlet disposed radially outwardly from said outer annular outlet; and a plurality of vanes that are connected between said body and said swirl cone, said vanes being located between said air chamber and said inner annulus and canted with respect to the longitudinal center axis of the nozzle such that air flowing from the air chamber forms a swirling flow pattern in said inner annulus.

10. The nozzle of claim 9 wherein the fuel orifices are located at a shorter radius from the central axis than said vanes.

11. The nozzle of claim 9 or 10 wherein said swirl cone includes a plurality of passageways between the air chamber and the outer annulus, each of said passageways being aligned on an axis that is skewed with respect to the center axis of the nozzle such that they do not intersect the longitudinal center axis and the air flowing from the air chamber through said passageways has a swirling flow pattern in the outer annulus.

12. A fuel nozzle comprising:

a housing;

a nozzle body that engages said housing and defines an air chamber therebetween, an air inlet to said air chamber, said body further including at least one fuel chamber and having radially aligned passageways between said fuel chamber and respective fuel orifices that are adjacent one end of said body;

a swirl cone located between the housing and the nozzle body adjacent to the fuel orifices in the nozzle body; said cone cooperating with said body to form an inner annulus with said fuel orifices included therein; said swirl cone also cooperating with said housing to form an outer annulus, said cone having passageways therein that are in a plane tangential to the central axis of said body to provide a swirled air flow of relatively high velocity in said outer annulus in response to relatively high pressure air in said air chamber, said inner annulus terminating in an inner annular outlet, said outer annulus terminating in an outer annular outlet; and a plurality of vanes that are connected between said nozzle body and said swirl cone, said vanes being canted with respect to the longitudinal center axis of said body and connected to the body at a greater radius from the center axis than the fuel orifices in said body such that said vanes provide high-velocity swirling air in said inner annulus adjacent the fuel orifices in response to high pressure air in said chamber.

13. The nozzle of claim 12 wherein said body defines two fuel chambers connected together and arranged in tandem.

14. The nozzle of claim 13 wherein the fuel chamber communicating with the passageways is smaller in volume than the other fuel chamber.

* * * * *